US008356711B2

(12) United States Patent
Canziani Hoffa et al.

(10) Patent No.: US 8,356,711 B2
(45) Date of Patent: Jan. 22, 2013

(54) HERMETIC CLOSING SYSTEM, ADDITIVE DISPENSER, FOR CONTAINERS AND/OR BOTTLES

(76) Inventors: Mauro Andres Canziani Hoffa, Santiago (CL); Jorge Francisco Aninat Solar, Santiago (CL)

( * ) Notice: Subject to any disclaimer, the term of this patent is extended or adjusted under 35 U.S.C. 154(b) by 445 days.

(21) Appl. No.: 12/632,929

(22) Filed: Dec. 8, 2009

(65) Prior Publication Data

US 2010/0163509 A1 Jul. 1, 2010

(30) Foreign Application Priority Data

Dec. 17, 2008 (CL) ..... 3761-2008

(51) Int. Cl.

| | |
|---|---|
| ***B65D 25/08*** | (2006.01) |
| ***B65D 17/44*** | (2006.01) |
| ***B65D 83/04*** | (2006.01) |
| ***B65D 39/00*** | (2006.01) |

(52) U.S. Cl. ..... 206/222; 220/278; 206/535; 215/227

(58) Field of Classification Search ..... 215/227–229, 215/251–256, DIG. 8; 222/522, 80, 81, 129, 222/145.5, 145.6, 545; 206/535, 222, 219; 220/277, 278, 254.1, 284

See application file for complete search history.

(56) References Cited

U.S. PATENT DOCUMENTS

| | | | | |
|---|---|---|---|---|
| 2,642,870 | A | | 6/1953 | Smith |
| 2,721,552 | A | | 10/1955 | Andre |
| 3,156,369 | A | | 11/1964 | Bowes et al. |
| 3,220,588 | A | | 11/1965 | Lipari |
| 3,840,136 | A | * | 10/1974 | Lanfranconi et al. ..... 215/6 |
| 3,924,741 | A | | 12/1975 | Kachur et al. |
| 3,968,872 | A | | 7/1976 | Cavazza |
| 5,456,374 | A | | 10/1995 | Beck |
| 5,884,759 | A | | 3/1999 | Gueret |
| 6,003,728 | A | * | 12/1999 | Elliott ..... 222/81 |
| 6,050,452 | A | * | 4/2000 | Pradinas ..... 222/153.02 |
| 6,148,996 | A | | 11/2000 | Morini |
| 6,230,884 | B1 | | 5/2001 | Coory |
| 6,415,966 | B1 | | 7/2002 | Pradinas et al. |
| 6,874,664 | B1 | * | 4/2005 | Montgomery ..... 222/525 |

(Continued)

FOREIGN PATENT DOCUMENTS

| | | | |
|---|---|---|---|
| GB | 2452676 | A | 3/2009 |
| WO | 9800348 | A1 | 1/1998 |

(Continued)

*Primary Examiner* — Bryon Gehman
*Assistant Examiner* — Shawn Braden
(74) *Attorney, Agent, or Firm* — Hultquist, PLLC; Steven J. Hultquist; Kelly K. Reynolds

(57) ABSTRACT

A system for closing containers of the bottle and/or jar type, which also dispenses active formulas from an airtight tubular space in its interior, into liquid or other content of a container when a mix is required. The system includes a movable push-cut carriage that is driven mechanically by an external puller to cut the seals of the tubular space and push the active formulas towards the interior of a bottle or jar. The closing system can be used for the incorporation of elements such as vitamins or minerals, which need to be stored separately from the content of the container in order to increase their useful life and improve their effectiveness, and in medical and/or pharmacological applications, to form mixtures of active formulas when they are required, thereby avoiding the rapid degradation of the final composition.

7 Claims, 8 Drawing Sheets

U.S. PATENT DOCUMENTS

| | | | | |
|---|---|---|---|---|
| 7,703,642 | B2 * | 4/2010 | Scott | 222/522 |
| 7,748,550 | B2 * | 7/2010 | Cho | 215/228 |
| 7,870,952 | B2 * | 1/2011 | Fontana | 206/222 |
| 8,011,534 | B2 * | 9/2011 | Roth et al. | 222/83 |
| 2001/0001196 | A1 | 5/2001 | Hawthorne | |
| 2007/0023381 | A1 | 2/2007 | Cerveny | |
| 2008/0116221 | A1 * | 5/2008 | Roth et al. | 222/129 |
| 2008/0142473 | A1 * | 6/2008 | Cho | 215/252 |
| 2009/0057262 | A1 | 3/2009 | Cho | |
| 2010/0059394 | A1 * | 3/2010 | Fontana | 206/222 |
| 2010/0187257 | A1 * | 7/2010 | Roth et al. | 222/129 |
| 2010/0237075 | A1 * | 9/2010 | Wilhelm | 220/284 |

FOREIGN PATENT DOCUMENTS

| | | | |
|---|---|---|---|
| WO | 02074647 | A1 | 9/2002 |
| WO | 02098760 | A1 | 12/2002 |
| WO | 03097478 | A1 | 11/2003 |
| WO | 2005012125 | A1 | 2/2005 |
| WO | 2006099768 | A1 | 9/2006 |
| WO | 2007010560 | A1 | 1/2007 |
| WO | 2007117070 | A1 | 10/2007 |
| WO | 2008061766 | A1 | 5/2008 |
| WO | 2008117321 | A1 | 10/2008 |
| WO | 2009014351 | A1 | 1/2009 |
| WO | 2009031864 | A1 | 3/2009 |

* cited by examiner

HERMETIC CLOSING SYSTEM, ADDITIVE DISPENSER, FOR CONTAINERS AND/OR BOTTLES

CROSS REFERENCE TO RELATED APPLICATION

The priority of Chilean Patent Application No. 3761-2008, filed on Dec. 17, 2008 is hereby claimed under the provisions of 35 USC 119. The disclosure of Chilean Patent Application No. 3761-2008 is hereby incorporated herein by reference in its respective entirety, for all purposes.

TECHNICAL FIELD

This invention refers to a system for closing containers of the bottle and/or jar type, which, at the same time, is a dispenser of active formulas placed inside an airtight space created in its interior, counting on specially designed means to be able to evacuate them towards the liquid or content of the bottle at the moment when the mixture needs to be made.

This closing system is equipped with an airtight tubular space designed to contain active formulas in its interior, and that at the same time contains a movable push-cut carriage that is moved mechanically by an external puller to cut the seals of said tubular space and push the active formulas towards the interior of a bottle or jar that contains liquids inside it, thus permitting the mixing of the formula with the content of the bottle at the moment it is required.

This type of closing system is now being used in the food area for the incorporation of elements such as vitamins or minerals, a process known as fortification, in which its components need to be stored separately from the content of the container in order to protect them hermetically from the humidity, the light, thus increasing their useful life and improving their effectiveness.

Similarly, these closing systems that permit the adding of substances, are used in the medical and/or pharmacological field, permitting the mixing of active formulas, such as, for example, probiotics at the moment they are required so as to avoid the rapid degradation of the final compound; in both cases, what is wanted is to free a particular additive, hermetically contained, brief moments prior to using and/or consuming the content of the container, permitting the mixing and subsequent freeing of the product that is already mixed without needing to remove the system that seals the bottle or jar.

BACKGROUND ART

At present, different alternatives can be found of systems that permit freeing solid or gaseous additives towards the interior of the container to which they are attached.

Sealing systems are known in the state-of-the-art that have a cavity for storing an additive that is set free towards the interior of the container by pressing vertically against a part of the system, thus permitting the perforation and/or pressuring of a seal that closes said cavity.

In applications US 2007/0023381 and WO2008/061766 we see systems that present in their interior a closed compartment or volume, with an upper wall formed by a flexible membrane and a base formed by a collapsible layer that breaks when pressure is exerted on the membrane, thus setting the additive free toward the interior of the container. In these cases, the additive is limited to those formats in a liquid or solid state that permit the transmitting of mechanical pressure exercised by the user to break the seal.

One of the limiting factors that can be observed in the mentioned references is that once the additive has been freed into the interior of the container, the closing system must be removed completely in order to consume or use said content.

Another unsolved point is the process whereby the inferior seal is broken which, when executed under pressure, does not permit controlling the cutting process and there is proof that parts of the sealing membrane can fall into the interior liquid of the bottle.

One of the qualities of this invention is that it does not require the removal of the closing system in order to use the product of the container or else consume the liquid once it is mixed.

On the other hand, thanks to the shape of an interior push-cut carriage, the additive is not limited to a solid or liquid format that exercises pressure and breaks the seal, but rather it permits the freeing of substances in powder, liquid or solid form indistinctly and with total control of the cutting process, so that waste from the seal cannot fall inside the bottle.

In the case of application WO 02/074647, a closure device is seen of the 'push and pull' type, with a sliding piece surrounded by a ring which in its lower position permits puncturing and pressing down on a membrane that is a seal commonly applied by induction in bottles or containers, to subsequently free towards the exterior the liquid contained in the container or bottle.

In the above-described case, the principal difference with the closing system of this application is that the device of the prior art is designed to be placed on a bottle that in its upper part already has a lid, a seal placed by induction, and that does not permit and neither is it designed to dispense formulas or active components towards the interior of the bottle as is the case of the invention presented in this application. In the latter, a closing system is provided that permits keeping the additive hermetically isolated without needing to seal the bottle.

DISCLOSURE OF INVENTION

The object of this invention is the protection of a closing system for a container of the bottle, jar or similar type, in which said system presents a configuration that permits the addition or liberation, by mechanical means, of an additive or active principle towards the interior of the container to which it is attached. This substance can be in a solid state (in the shape of a tablet or powder, granular or another format) or liquid (liquid, gel or the like).

In this case, the additive is maintained hermetically isolated from the exterior, both during its storage and during its liberation.

This system has a structure formed by four pieces: one cover, one actuator or puller, the basic body of the system and a mobile push-pull carriage. These pieces are interlocked, forming a single unit that is the closing system.

BEST MODE FOR CARRYING OUT THE INVENTION

Figure 1:
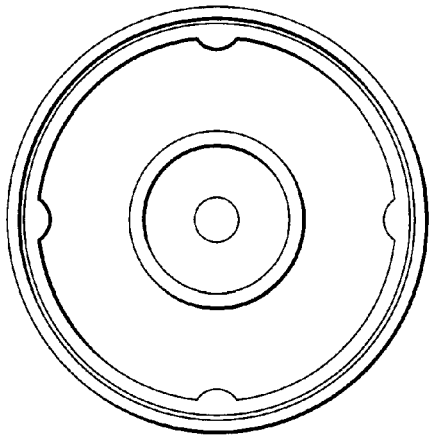
FIG. 1: shows a bottom view of the cover (1).
Figure 2:
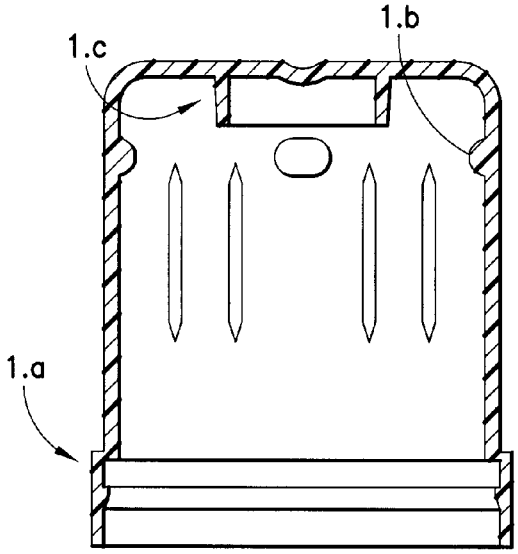
FIG. 2: shows a sectional view of the cover (1).
Figure 3:
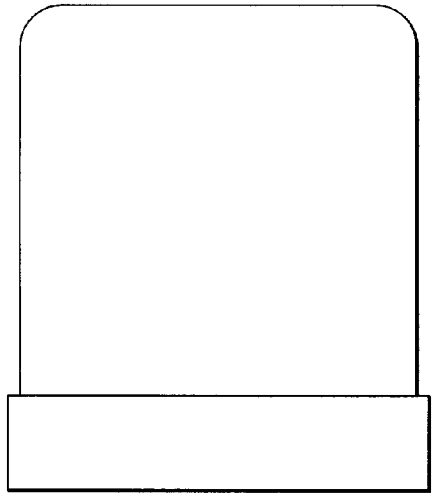
FIG. 3: shows a lateral view of the cover (1).

The description of the figures of this presentation, corresponding to the best mode for carrying out the invention, permits a better understanding of the system whose protection is being sought and its components:

FIGS. 1-3 show the cover (1) or hood, which consists of a body preferably circular, elongated, closed in its upper part, and open in its lower part, which includes:

- a grooved safety ribbon (1.*a*) attached in its lower open border;
- a projection (1.*b*) formed in the contour of the internal surface of the elongated body, in its upper portion; and
- a sealing tongue-shaped element (1.*c*) placed circularly in the upper part of the cover that extends towards the interior of said cover.

Figure 4:
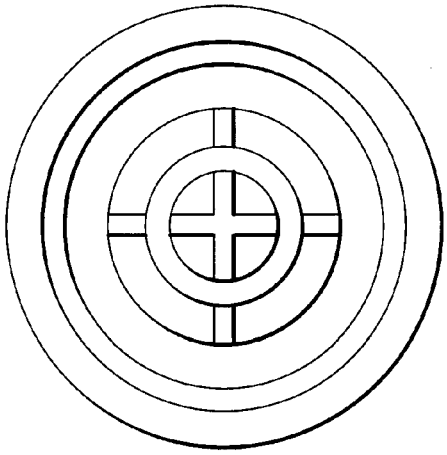
FIG. 4: shows a bottom view of the actuator or puller (2) of the system.
Figure 5:
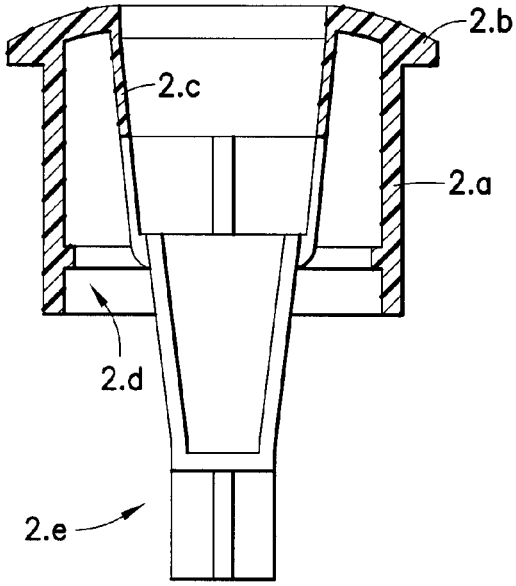
FIG. 5: shows a sectional view of the actuator or puller (2) of the system.
Figure 6:
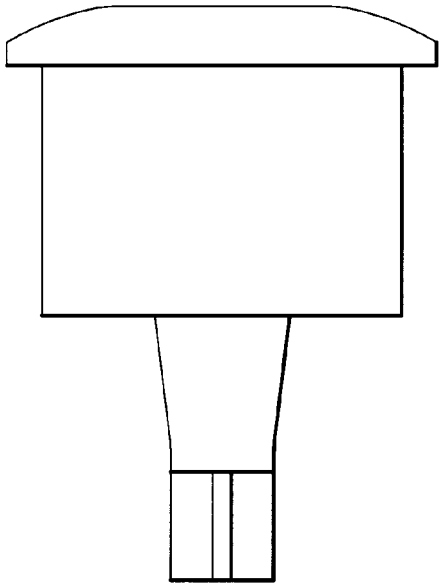
FIG. 6: shows a lateral view of the actuator or puller (2) of the system.
Figure 7:
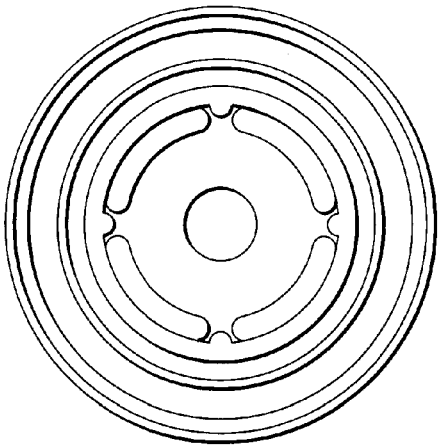
FIG. 7: shows a top view of the basic body (3) of the system.
Figure 8:
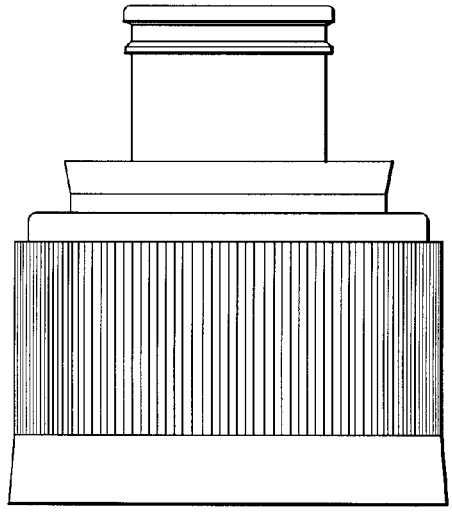
FIG. 8: shows a lateral view of the basic body (3) of the system.
Figure 9:
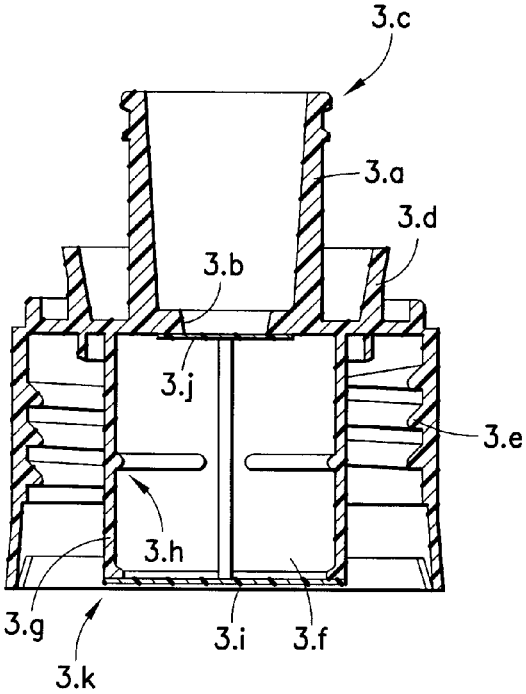
FIG. 9: shows a sectional view of the basic body (3) of the system.
Figure 10:
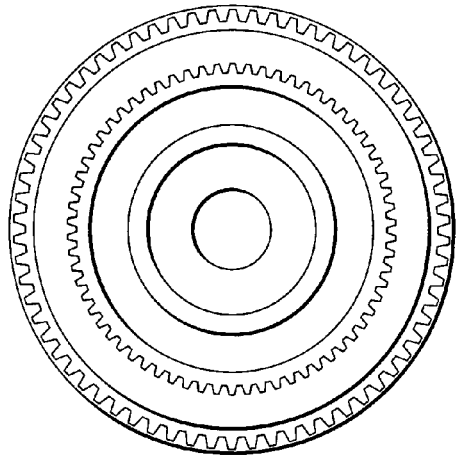
FIG. 10: shows a bottom view of the basic body (3) of the system.

FIGS. 4-6 present the actuator or puller (2) of the system that consists of a sliding piece with a central passant vertical perforation and that is formed by:

- an exterior circular wall (2.*a*) that presents a shoulder (2.*b*) in the perimeter of its upper border;
- an interior surface (2.*c*) that surrounds the central perforation, with a conical shape, and which takes a cylindrical form in its inferior portion and ends in a cross-shaped cut and push element (2.*e*);
- a ring or projection (2.*d*) in the exterior wall and placed circularly towards the free space existing between the exterior wall and the interior conical surface.

In FIGS. 7-10 the basic body (3) of the system can be seen, which is made up of:

- a mouthpiece (3.*a*) with a central conical perforation (3.*b*) in its lower surface, and that presents a peripheral projection (3.*c*) in the upper end of this mouthpiece;
- a tongue-shaped ring (3.*d*) connected in its interior margin to the mouthpiece and in its exterior margin to a flap;
- a flap (3.*e*) threaded internally, that engages the external thread of the container to which the system is attached;
- a central compartment or tubular space (3.0 inside the flap, connected to the mouthpiece (3.*a*) through the conical perforation (3.*b*) that is open by its lower portion, which is surrounded by a wall (3.*g*) that presents a projection on its inside (3.*h*) in its central portion: membranes that hermetically seal the central compartment (3.0 in its inferior portion (3.*i*) and in the superior (3.*j*).

Figure 11:
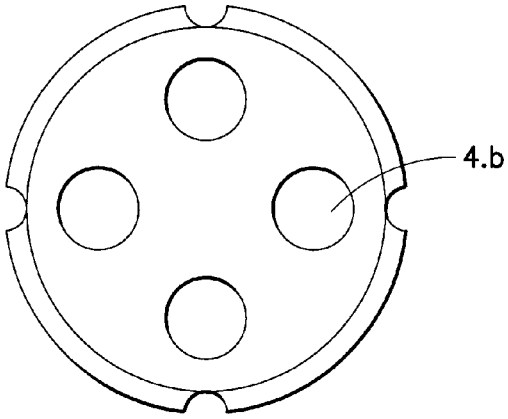
FIG. 11: shows a top view of the push-cut carriage (4).
Figure 12:
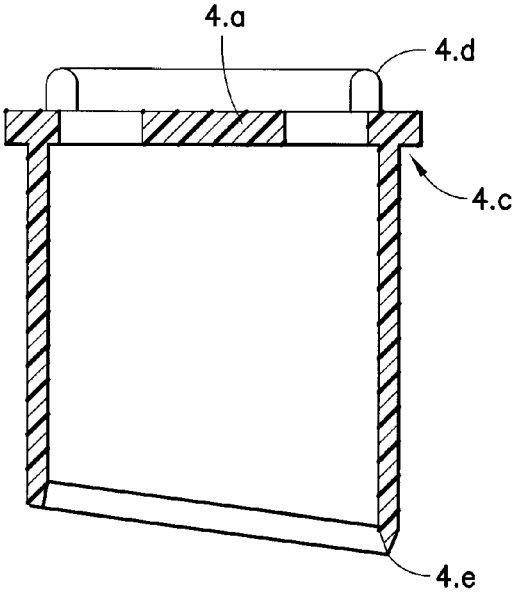
FIG. 12: shows a sectional view of the push-cut carriage (4).
Figure 13:
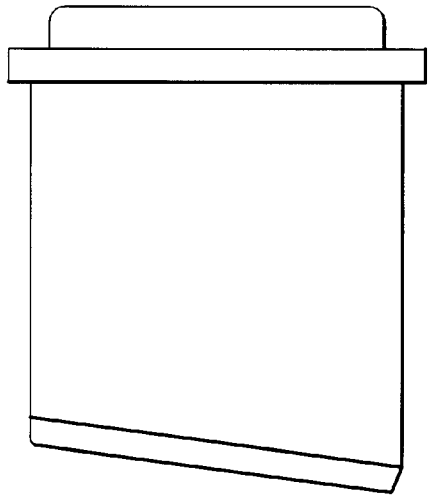
FIG. 13: shows a lateral view of the push-cut carriage (4).

FIGS. 11-13 show the push-cut carriage (4) that consists of an interior, mobile compartment where the additive that will be freed is stored, and is formed by:

- cylindrical lateral walls with a superior seal (4.*a*) that has perforations (4.*b*); these lateral walls, presenting a projecting shoulder (4.*c*) at the height of said superior closure (4.*a*);
- ribbing (4.*d*) set out on the external surface of said seal; the lower end of the cylindrical lateral wall presents an oblique cut (4.*e*) and a sharp guillotine-shaped finish.

Figure 14:
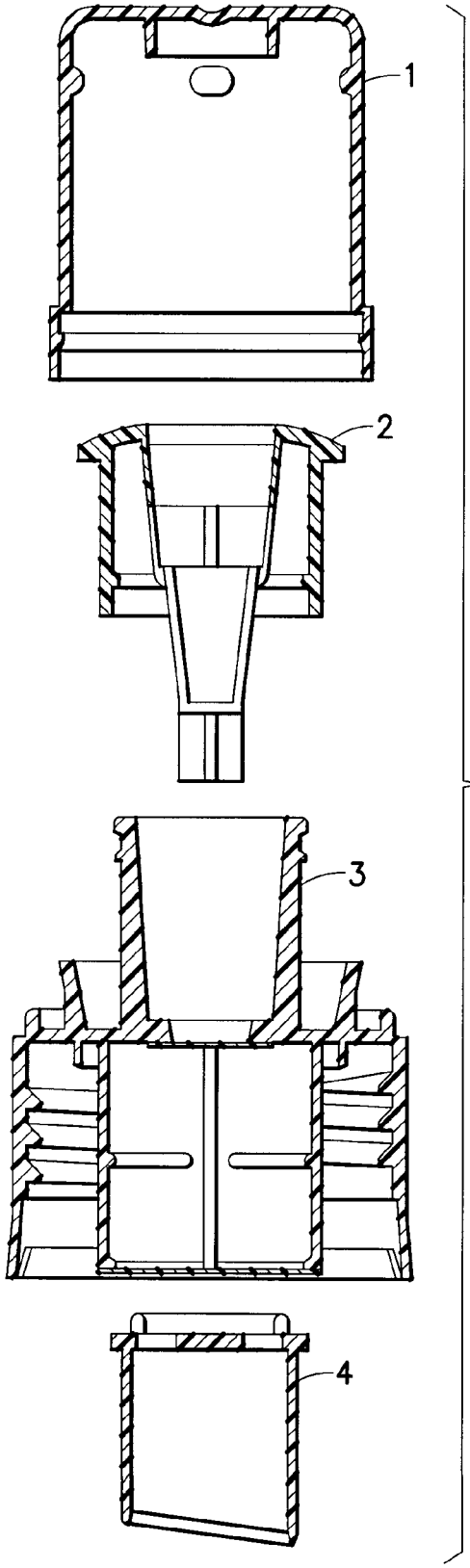
FIG. 14: shows the closing system in an exploded view.

FIG. 14 shows the component parts of the current closing system, in a blown up version and in the configuration in which they are fitted together for their utilization.

Figure 15:
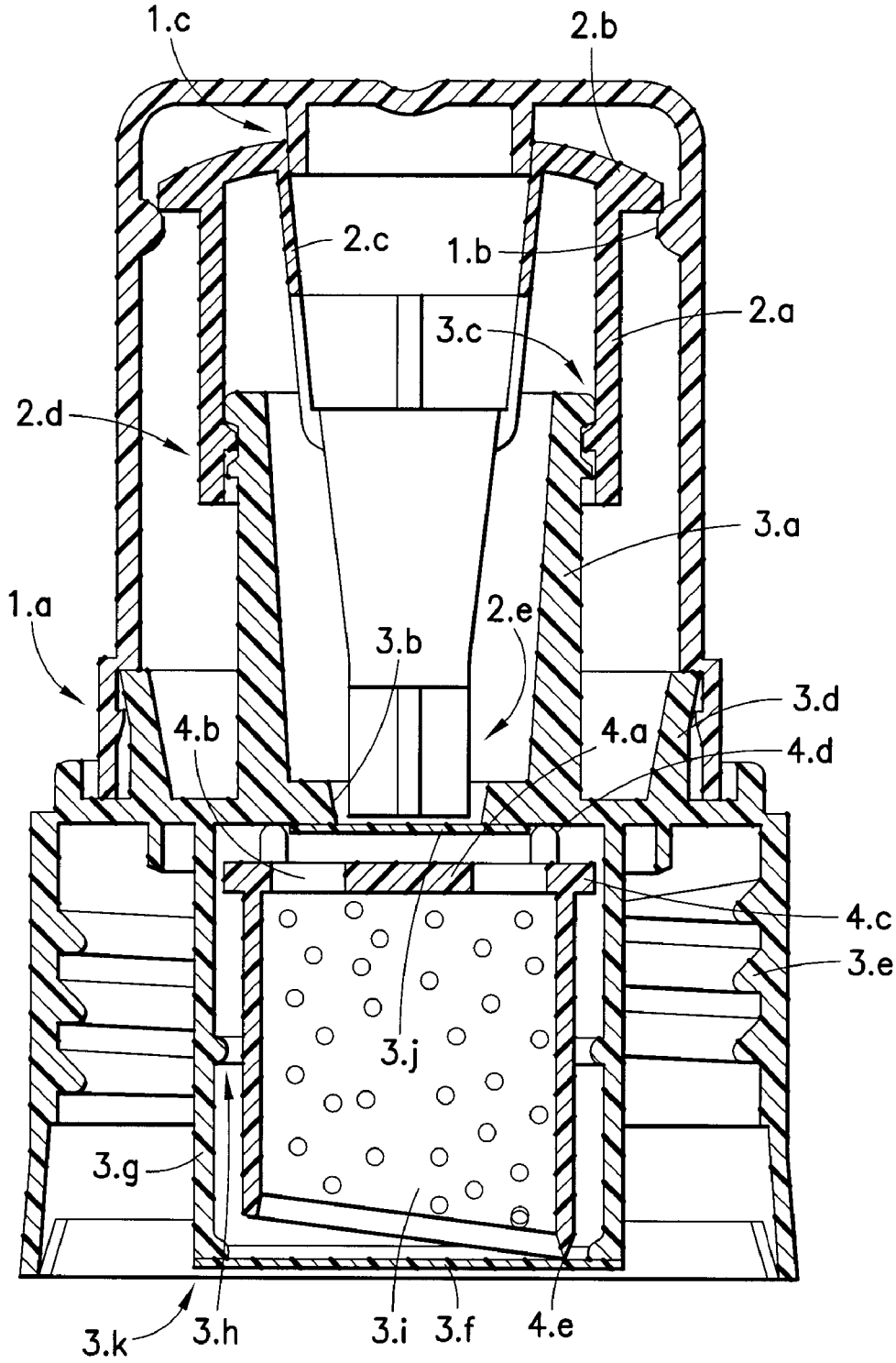
FIG. 15: shows the closing system fitted together, in its closed position.

FIG. 15 shows the same system but fitted together, in its closed position, with its four component pieces, just as it stays attached to the container; this view shows the push-cut carriage (4) that contains the additive that is to be set free and is found inside the central compartment (3.*f*) of the basic body (3) of the system and hermetically isolated by the membranes (3.*i*, 3.*j*) that seal said compartment.

Figure 16:
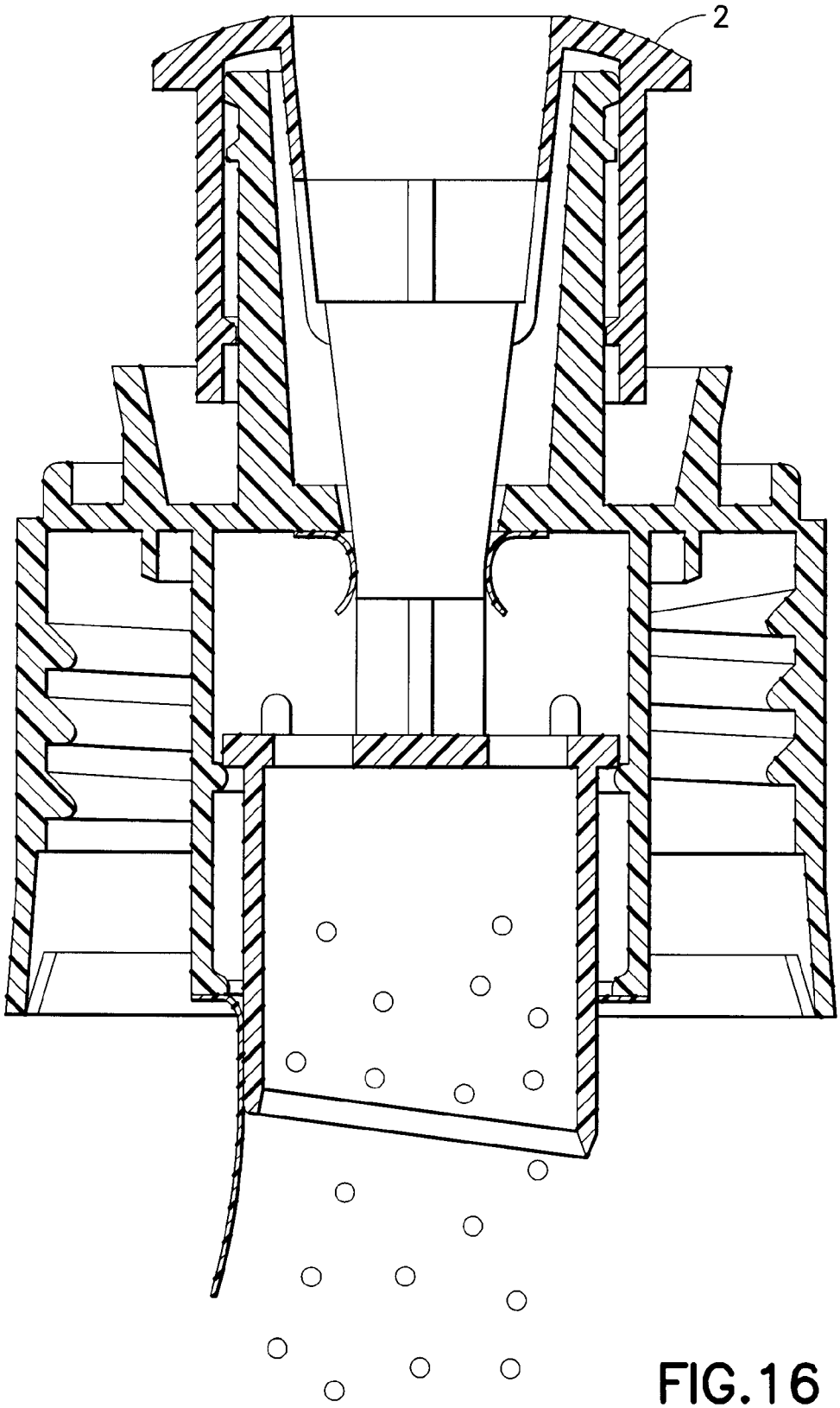
FIG. 16: shows the closing system in discharge position.

FIG. 16 shows the system in discharge position, and the actuator (2) has descended pushing the carriage, which has partially cut the lower seal and freed the additive toward the interior of the container.

Figure 17:
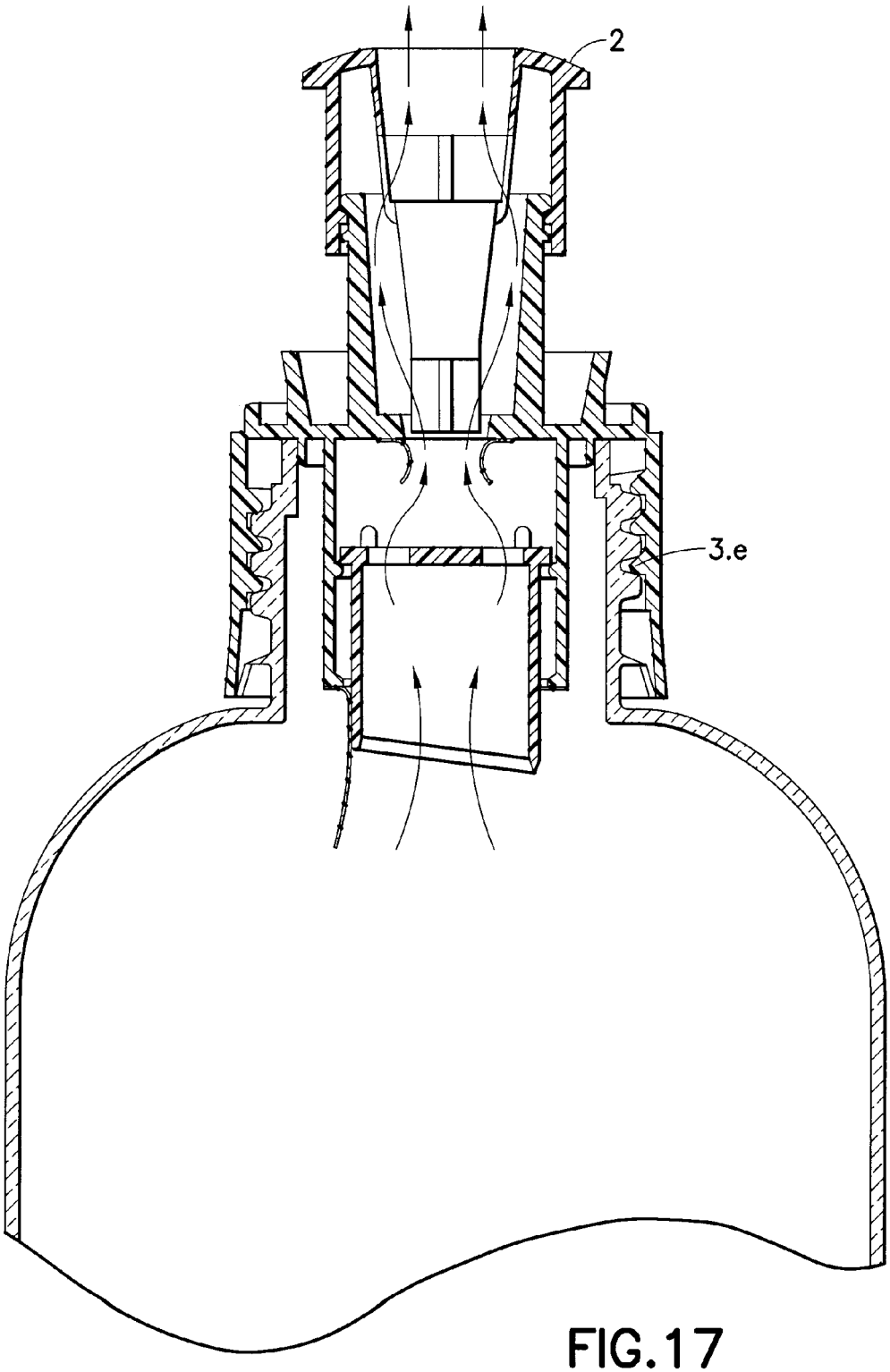
FIG. 17: shows the closing system in the open position.

FIG. 17 shows the closure system, in the open position, that is, once the additive has been released towards the interior of the container, and the puller (2) rises once again, thus communicating the exterior with the interior of the container. In this position, the mixed content inside the container can be used.

The closure system of the invention is attached to a bottle-type container or the like, by engaging the thread of the flap (3.*e*) to the external thread on the container.

In its closed position, that is, when the system has not yet been manipulated, the cover (1) is engaged to the ring (3.*d*) of the basic body, in the zone of its safety ribbon (1.*a*).

In this position, the actuator (2) leans its exterior wall (2.*a*) over the mouthpiece (3.*a*) of the basic body, generating a contact between its peripheral shoulder (2.*b*) and the internal projection (1.*b*) of the cover, as well as the engaging of its exterior ring (2.*d*) with the upper projection (3.*c*) that has the mouthpiece of the basic body. The contact between the mentioned parts establishes closed volumes between the hood (1), the basic body (3) and the actuator (2), which form a barrier that keeps air or contaminants from passing towards the sector in which the additive is stored.

The central perforation of the actuator (2), in its turn, remains closed to the passing of air or humidity towards its interior because the tongue of the seal (1.*c*) of the cover remains in contact with the entire contour of the interior surface (2.*c*) of the actuator, forming an additional isolating volume.

In this same position of the system, closed, the carriage (4) lies inside the central compartment (3.*f*) of the basic body and hermetically isolated by the upper and lower membranes (3.*l*, 3.*j*).

One modality for manufacturing said airtight membranes is the utilization of aluminum sheets, covered with an epoxy material and sealed over the surfaces of the central compartment (3.*f*) by a process of pressure and heat, which permits joining them to the basic body of the system. The sealing membranes that can be used in the execution of this closing system, are not limited to the above description, other materials or other sealing systems may be used.

At the moment when one wants to dispense the additive into the bottle, the cover (1) must be removed, which will cause the safety ribbon (1.*a*) to become detached, the basic body (3) of the system will remain attached to it.

Subsequently, the actuator (2) is pushed by the user towards the interior of the container, causing its lower cross-shaped portion (2.*e*) to break the membrane of the upper seal (3.*j*), thus introducing itself into the central compartment (3.*f*) where it in turn pushes the mobile carriage (4).

When the carriage (4) is pushed and displaced downwards, its guillotine-shaped inferior border (4.*e*) partially cuts the membrane of the lower seal (3.*i*), thus permitting the liberation of the additive towards the interior of the container; the projecting shoulder of the carriage (4.*c*) is stopped from advancing by the internal projection (3.*h*) of the central compartment, where it remains engaged, thus preventing the sealing membrane (3.*i*) from being cut entirely and falling into the container together with the additive. The mixing of the additive in the liquid contained initially in the bottle can then be carried out. At the same time, the inferior conical part of the actuator perfectly seals the space through which it penetrated the tubular space, thus permitting shaking and mixing the additive together with the liquid in the container without permitting the liquid to seep or spill toward the outside.

To be able to use the mixture or final content of the container, the actuator must be pulled back to its initial position, with which the liquid will pass through the perforations (4.*b*) that the carriage has in its superior closure (4.*a*), towards the central perforation of the actuator. This proves that removing the closure system is not necessary in order to be able to drink or use the mixture that was produced inside the container.

The material of the system is a rigid material, preferably but not limited to the use of plastic materials in its manufacture.

What is claimed is:

1. A closing system for a container, which in turn permits dispensing towards an interior region of the container an additive maintained hermetically isolated, wherein the closing system comprises:

a) a cover comprising an elongated circular body, closed in a cover upper part and open in a cover lower part, including:
   - a grooved safety ribbon attached to the cover lower part;
   - a projection formed in a contour of an internal surface of the elongated circular body, in the cover upper part; and
   - a tongue-shaped sealing element placed circularly in the cover upper part, that extends towards the interior of said cover;

b) an actuator, which includes a sliding piece with a vertical central hole and that is formed by:
   - an exterior circular wall that presents a protrusion extending exteriorly from an actuator upper border;
   - an cone-shaped interior surface that surrounds the central hole, which takes a cylindrical shape in an actuator lower portion and ends in a cross-shaped cut and push element; and
   - a ring or projection in the exterior circular wall and placed circularly towards the interior surface;

c) a basic body including:
   - a mouthpiece with a central conical hole in an interior surface of the body and that presents a peripheral projection in an upper end of the mouthpiece;
   - a tongue-shaped ring in the connected at an interior margin to the mouthpiece and at an exterior margin to a flap;
   - an internally-threaded flap that is coupled with an external thread of the container when the closing system is attached to the container;
   - a central compartment or tubular space inside the flap, connected to the mouthpiece through the conical hole and that is open at a lower part of the central compartment, which is surrounded by a wall that presents a projection into an interior portion; and
   - membranes that hermetically seal the central compartment in a central compartment lower part and upper part; and d) a push-cut carriage, that corresponds to an interior, mobile compartment where an additive that will be released is stored, the carriage comprising:
   - lateral cylindrical walls, with an upper closing that comprises holes;
   - said lateral walls comprising a projecting shoulder at the height of said upper closing;
   - grooves on an external surface of said closing; and
   - a lower end of the lateral cylindrical walls comprising an oblique cut and a sharp guillotine-shaped end.

2. The closing system of claim 1, wherein the membranes that seal the central compartment comprise aluminum sheets, covered with an epoxy material and that are united and sealed on the surfaces of the central compartment by consolidation under pressure and heat.

3. The closing system of claim 1, wherein the material used to manufacture components of the system comprises a rigid material.

4. The closing system of claim 3, wherein the rigid material comprises a plastic material.

5. The closing system of claim 1, wherein in a closed position, diverse isolated volumes are defined between the cover, the basic body and the actuator, when the protrusion of the actuator enters into contact with the projection of the cover upper part, as well as the volumes produced by an engaging of the ring of the actuator with the peripheral projection of the mouthpiece of the basic body, and the volumes of the vertical central hole of the actuator, whose internal surface seals against the sealing element of the cover, said volumes forming a barrier that prevents air or contaminants from passing towards a sector in which the additive is stored.

6. The closing system of claim 1, wherein the projection of the central compartment is placed such that the projecting shoulder of the carriage is engaged with the projection of the central compartment, and detains the movement of the carriage when it dispenses the additive an prevents the membrane of the central compartment lower part from being cut entirely.

7. The closing system of claim 1, wherein the container is a jar or a bottle.

* * * * *